US008989415B2

(12) United States Patent
Wilson

(10) Patent No.: US 8,989,415 B2
(45) **Date of Patent: *Mar. 24, 2015**

(54) HEARING AID NOISE REDUCTION METHOD, SYSTEM, AND APPARATUS

(71) Applicant: Sonic Innovations, Inc., Salt Lake City, UT (US)

(72) Inventor: Gerald Wilson, South Jordan, UT (US)

(73) Assignee: Sonic Innovations, Inc., Salt Lake City, UT (US)

( * ) Notice: Subject to any disclaimer, the term of this patent is extended or adjusted under 35 U.S.C. 154(b) by 12 days.

This patent is subject to a terminal disclaimer.

(21) Appl. No.: 13/681,190

(22) Filed: Nov. 19, 2012

(65) Prior Publication Data

US 2013/0077807 A1 Mar. 28, 2013

Related U.S. Application Data

(62) Division of application No. 12/040,507, filed on Feb. 29, 2008, now Pat. No. 8,340,333.

(51) Int. Cl.
*H04R 25/00* (2006.01)

(52) U.S. Cl.
CPC ..... *H04R 25/453* (2013.01)
USPC ..... 381/317; 381/318; 381/94.1

(58) Field of Classification Search
None
See application file for complete search history.

(56) References Cited

U.S. PATENT DOCUMENTS 3,600,524 A 8/1971 Biondi et al.
3,668,702 A 6/1972 Jones
4,025,721 A 5/1977 Graupe et al.
4,276,624 A 6/1981 Fisher et al.
4,589,083 A 5/1986 Le Dinh et al.
4,630,305 A 12/1986 Borth et al.
5,222,189 A 6/1993 Fielder
5,402,496 A 3/1995 Soli et al.
5,412,735 A 5/1995 Engebretson et al.
5,416,844 A 5/1995 Nakaji et al.
5,659,583 A 8/1997 Lane
5,745,581 A 4/1998 Eatwell et al.
5,867,581 A 2/1999 Obara
5,903,615 A 5/1999 Thomson et al.
5,982,901 A 11/1999 Kane et al.
6,073,100 A 6/2000 Goodridge, Jr.
6,173,062 B1 1/2001 Dibachi et al.
6,351,664 B1 2/2002 Brodnick
6,418,227 B1 7/2002 Kuo
6,480,610 B1 11/2002 Fang et al.
6,498,820 B1 12/2002 Thomson et al.
6,868,163 B1 3/2005 Goldstein
7,020,297 B2 3/2006 Fang et al.

(Continued)

*Primary Examiner* — Duc Nguyen
*Assistant Examiner* — Taunya McCarty
(74) *Attorney, Agent, or Firm* — Birch, Stewart, Kolasch & Birch, LLP

(57) ABSTRACT

A computer-implemented method including receiving a first signal from an input device of a hearing aid. The first signal may include a noise signal. The computer-implemented method may include low-pass filtering first periodic samples of the first signal, and the first periodic samples may be approximately periodic with respect to a period of the noise signal. The computer-implemented method may further include low-pass filtering second periodic samples of the first signal, and the second periodic samples may be approximately periodic with respect to the period of the noise signal. The second periodic samples may also be phase shifted relative to the first periodic samples. Hearing aid systems and apparatuses are also disclosed.

18 Claims, 8 Drawing Sheets

(56) References Cited

U.S. PATENT DOCUMENTS

| | | | |
|---|---|---|---|
| 7,031,402 | B2 | 4/2006 | Takada |
| 7,519,193 | B2 | 4/2009 | Fretz |
| 7,650,279 | B2 | 1/2010 | Hiekata et al. |
| 2003/0118139 | A1 | 6/2003 | Yamada |
| 2005/0047620 | A1 | 3/2005 | Fretz |
| 2005/0111683 | A1 | 5/2005 | Chabries et al. |
| 2005/0195990 | A1 | 9/2005 | Kondo et al. |
| 2005/0246170 | A1 | 11/2005 | Vignoli et al. |
| 2006/0008101 | A1 | 1/2006 | Kates |
| 2006/0204025 | A1 | 9/2006 | Paludan-Muller et al. |
| 2006/0287609 | A1 | 12/2006 | Litvak et al. |
| 2007/0030989 | A1 | 2/2007 | Kates |
| 2007/0183614 | A1 | 8/2007 | Kasztelan et al. |
| 2007/0239294 | A1 | 10/2007 | Brueckner et al. |
| 2007/0269069 | A1 | 11/2007 | Kornagel |
| 2008/0019538 | A1 | 1/2008 | Kushner et al. |
| 2008/0175422 | A1 | 7/2008 | Kates |
| 2009/0175466 | A1 | 7/2009 | Elko et al. |
| 2011/0040350 | A1 | 2/2011 | Griffith |

HEARING AID NOISE REDUCTION METHOD, SYSTEM, AND APPARATUS

CROSS REFERENCE TO RELATED APPLICATIONS

This application is a Divisional of copending application Ser. No. 12/040,507 filed on Feb. 29, 2008. The entire contents of all are hereby incorporated by reference.

BACKGROUND

Dealing with noise may be a significant obstacle in providing an effective hearing aid. Hearing aid users may have difficulty hearing desired audio signals due to electromagnetic interference, acoustic feedback, and various other noise signals. Some types of noise may be annoying and irritating to hearing aid users, and certain noise conditions may even render a hearing aid practically unusable.

Hearing aid manufacturers have implemented various technologies to address noise. For example, some hearing aids may attempt to boost gain in frequency subbands with low noise while reducing gain in frequency subbands with high noise. One problem with this frequency-gain approach is that desired signals may be attenuated along with noise signals. Another problem with many frequency-gain approaches to dealing with noise is the inaccuracy of traditional algorithms for detecting which frequency subbands contain noise. In other words, many traditional algorithms may be somewhat ineffective in distinguishing between noise signals and desired signals.

Frequency-gain technologies and other traditional noise reduction techniques may be particularly ineffective for dealing with certain types of noise. For example, electromagnetic interference within a hearing aid may be picked-up by a telecoil, and such electromagnetic interference may be periodic with a fundamental frequency and numerous strong harmonics. Periodic electromagnetic interference may span numerous frequency bands and may be difficult to address using traditional noise reduction technologies. Other periodic noise signals, such as acoustic feedback, may also be inadequately handled by many prior noise reduction techniques.

SUMMARY

The instant disclosure is directed to various computer-implemented methods and systems for addressing noise in hearing aids. Embodiments of the instant disclosure may be directed to methods for modeling noise, estimating noise, determining noise, reducing noise, canceling noise, or otherwise dealing with noise. Some embodiments may also be directed to hearing aid devices configured to address noise.

In at least one embodiment, a computer-implemented method may comprise receiving a first signal from an input device of a hearing aid. The first signal may comprise a noise signal. The computer-implemented method may also comprise low-pass filtering first periodic samples of the first signal. The first periodic samples may be approximately periodic with respect to a period of the noise signal. The computer-implemented method may also comprise low-pass filtering second periodic samples of the first signal. The second periodic samples may be approximately periodic with respect to the period of the noise signal. The second periodic samples may be phase shifted relative to the first periodic samples.

According to some embodiments, low-pass filtering the first and second periodic samples may comprise determining a waveform of the noise signal. The computer-implemented method may further comprise subtracting the waveform of the noise signal from the first signal to provide a desired signal. The computer-implemented method may also comprise sending the desired signal to a receiver of the hearing aid.

In at least one embodiment, determining a waveform of the noise signal may comprise low-pass filtering a plurality of streams of periodic samples. The first periodic samples may comprise a first stream of periodic samples from the plurality of streams of periodic samples. The second periodic samples may comprise a second stream of periodic samples from the plurality of streams of periodic samples.

According to certain embodiments, one period of the noise signal may comprise a number of samples, and the number of streams in the plurality of streams of periodic samples may correspond to the number of samples in one period of the noise signal. For example, the number of streams in the plurality of streams of periodic samples may be equal to the number of samples in one period of the noise signal. In some embodiments, the period of the noise signal may comprise a period of a fundamental frequency of the noise signal. The fundamental frequency may comprise a value in the audio frequency range between 100 hertz and 10,000 hertz. The noise signal may also comprise a fundamental frequency and at least one harmonic of the fundamental frequency.

According to various embodiments, the input device may comprise a telecoil, and the noise signal may comprise electromagnetic interference. The electromagnetic interference may be created by the hearing aid. For example, the electromagnetic interference may be created by a power-supply loop in the hearing aid. In certain embodiments, the input device may comprise a microphone, and the noise signal may comprise acoustic feedback from the receiver. The period of the noise signal may correspond to a feedback-loop delay of the hearing aid.

In at least one embodiment, the computer-implemented method may comprise determining the period of the noise signal. The period of the noise signal may comprise a fundamental frequency of the noise signal. The computer-implemented method may further comprise synchronizing the process of low-pass filtering the first and second periodic samples with the period of the noise signal or conversely, synchronizing the period of the noise signal with the process of low-pass filtering the first and second periodic samples. Synchronization may comprise at least one of: duplicating a sample of the first signal, skipping a sample of the first signal, or interpolating samples of the first signal. Interpolation may comprise a sample rate conversion.

According to certain embodiments, a hearing aid may comprise an input device configured to output a first signal. The first signal may comprise a noise signal. The hearing aid may also comprise a receiver and a noise estimator in a signal path between the input device and the receiver. The noise estimator may comprise a first low-pass filter configured to filter first periodic samples of the first signal. The first periodic samples may be approximately periodic with respect to a period of the noise signal. The noise estimator may also comprise a second low-pass filter configured to filter second periodic samples of the first signal. The second periodic samples may be approximately periodic with respect to the period of the noise signal. The second periodic samples may be phase shifted relative to the first periodic samples.

In at least one embodiment, the noise estimator may be configured to estimate a waveform of the noise signal. In some embodiments, an arithmetic unit may be configured to subtract the waveform of the noise signal from the first signal to provide a desired signal. In some embodiments, the arithmetic unit may be configured to resynchronize the waveform of the estimated noise signal or the estimated desired signal to the first signal. Resynchronization may comprise a sample rate conversion.

The hearing aid may also comprise a plurality of low-pass filters. Each filter in the plurality of low-pass filters may be configured to filter a corresponding stream of periodic samples from a plurality of streams of periodic samples. Each stream of periodic samples in a plurality of streams of periodic samples may be phase shifted relative to every other stream of periodic samples in the plurality of streams of periodic samples. The first periodic samples may comprise a first stream of periodic samples from the plurality of streams of periodic samples. The second periodic samples may comprise a second stream of periodic samples from the plurality of streams of periodic samples.

According to at least one embodiment, one period of the noise signal may comprise a number of samples, and the number of low-pass filters in the plurality of low-pass filters may correspond to the number of samples in one period of the noise signal. The number of low-pass filters in the plurality of low-pass filters may be equal to the number of samples in one period of the noise signal. In various embodiments, the period of the noise signal may comprise a period of a fundamental frequency of the noise signal, and the fundamental frequency may comprise a value between 100 hertz and 10,000 hertz.

In some embodiments, the input device may comprise a telecoil. The noise signal may comprise electromagnetic interference, and the electromagnetic interference may be created by a power-supply loop in the hearing aid. In other embodiments, the input device may comprise a microphone. The noise signal may comprise acoustic feedback from the receiver. The period of the noise signal may correspond to a feedback-loop delay of the hearing aid.

The hearing aid may further comprise a period detector configured to determine the period of the noise signal. The period of the noise signal may comprise a fundamental frequency of the noise signal. The period detector may be configured to synchronize the noise estimator with the period of the noise signal or to synchronize the period of the noise signal with the noise estimator. The period detector may also be configured to cause the noise estimator to perform at least one of: duplicating a sample of the first signal, skipping a sample of the first signal, or interpolating samples of the first signal. Interpolation may comprise a sample rate conversion.

According to certain embodiments, a computer-implemented method may comprise receiving a first signal from a telecoil of a hearing aid. The first signal may comprise an interference signal, and the interference signal may comprise electromagnetic interference created by a power-supply loop in the hearing aid. The computer-implemented method may further comprise determining a waveform of the interference signal by low-pass filtering a first stream of periodic samples of the first signal. The first stream of periodic samples may be approximately periodic with respect to a period of a fundamental frequency of the interference signal. Determining a waveform of the interference signal may also comprise low-pass filtering a second stream of periodic samples of the first signal. The second stream of periodic samples may be approximately periodic with respect to the period of the fundamental frequency of the interference signal. The second stream of periodic samples may be phase shifted relative to the first stream of periodic samples. The method may also comprise subtracting the waveform of the interference signal from the first signal to provide a desired signal. The desired signal may then be sent to a receiver of the hearing aid.

According to at least one embodiment, one period of the interference signal may comprise a number of samples. For example, the number of streams in the plurality streams of periodic samples may be equal to the number of samples in one period of the noise signal. In some embodiments, the fundamental frequency may comprise a value that is an integer divisor of the audio sample rate. In at least one embodiment, the fundamental frequency may comprise a value of approximately 333 hertz.

BRIEF DESCRIPTION OF THE DRAWINGS

The accompanying drawings illustrate a number of exemplary embodiments and are part of the specification. Together with the following description, these drawings demonstrate and explain various principals of the instant disclosure.

Figure 1:
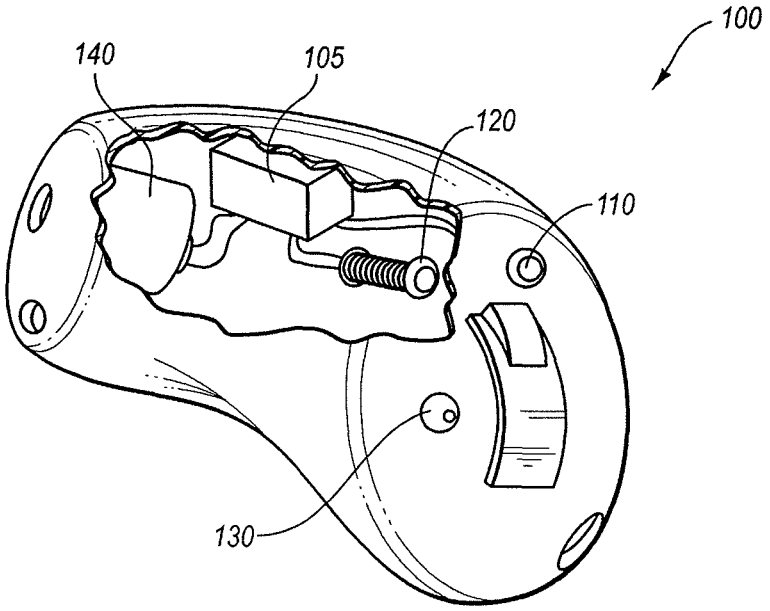
FIG. 1 is a perspective view of an exemplary hearing aid according to certain embodiments.

Throughout the drawings, identical reference characters and descriptions indicate similar, but not necessarily identical, elements. While the exemplary methods described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The following is intended to provide a detailed description of various exemplary embodiments and should not be taken to be limiting in any way. Various exemplary methods and systems for addressing noise in hearing aids are disclosed herein. For example, the instant disclosure presents computer-implemented methods and systems for canceling electromagnetic interference in hearing aids. Embodiments of the instant disclosure also provide noise cancellation methods and systems to deal with acoustic feedback. Embodiments of the instant disclosure may apply to various other types of noise. As disclosed in greater detail below, the systems, methods, and apparatuses disclosed herein may provide various advantages and features over prior noise reduction technologies.

Figure 2:
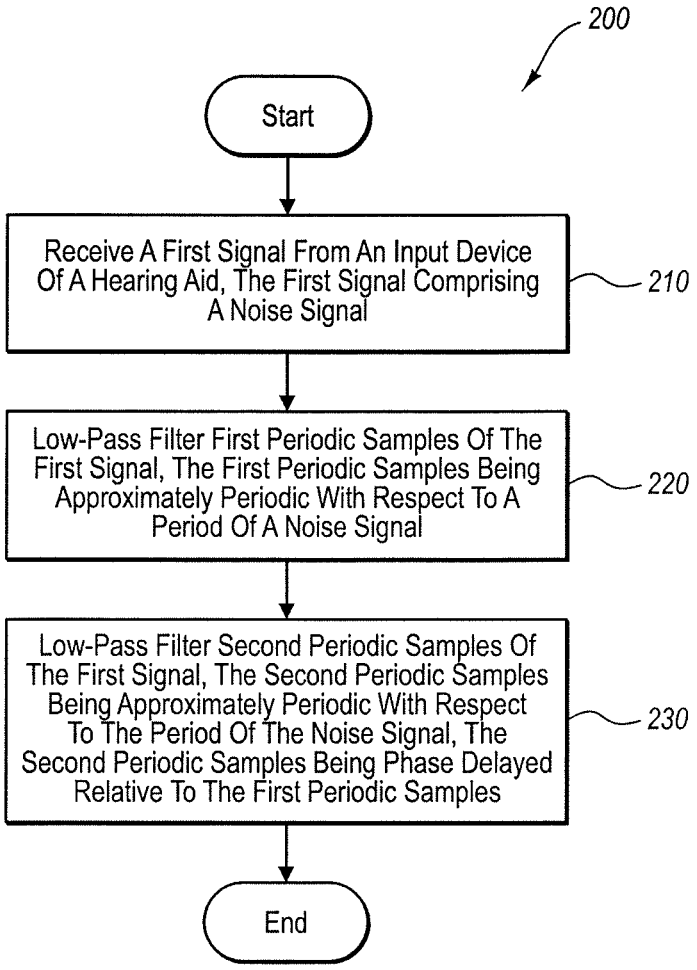
FIG. 2 is a flow diagram of an exemplary noise determination method according to certain embodiments.
Figure 3:
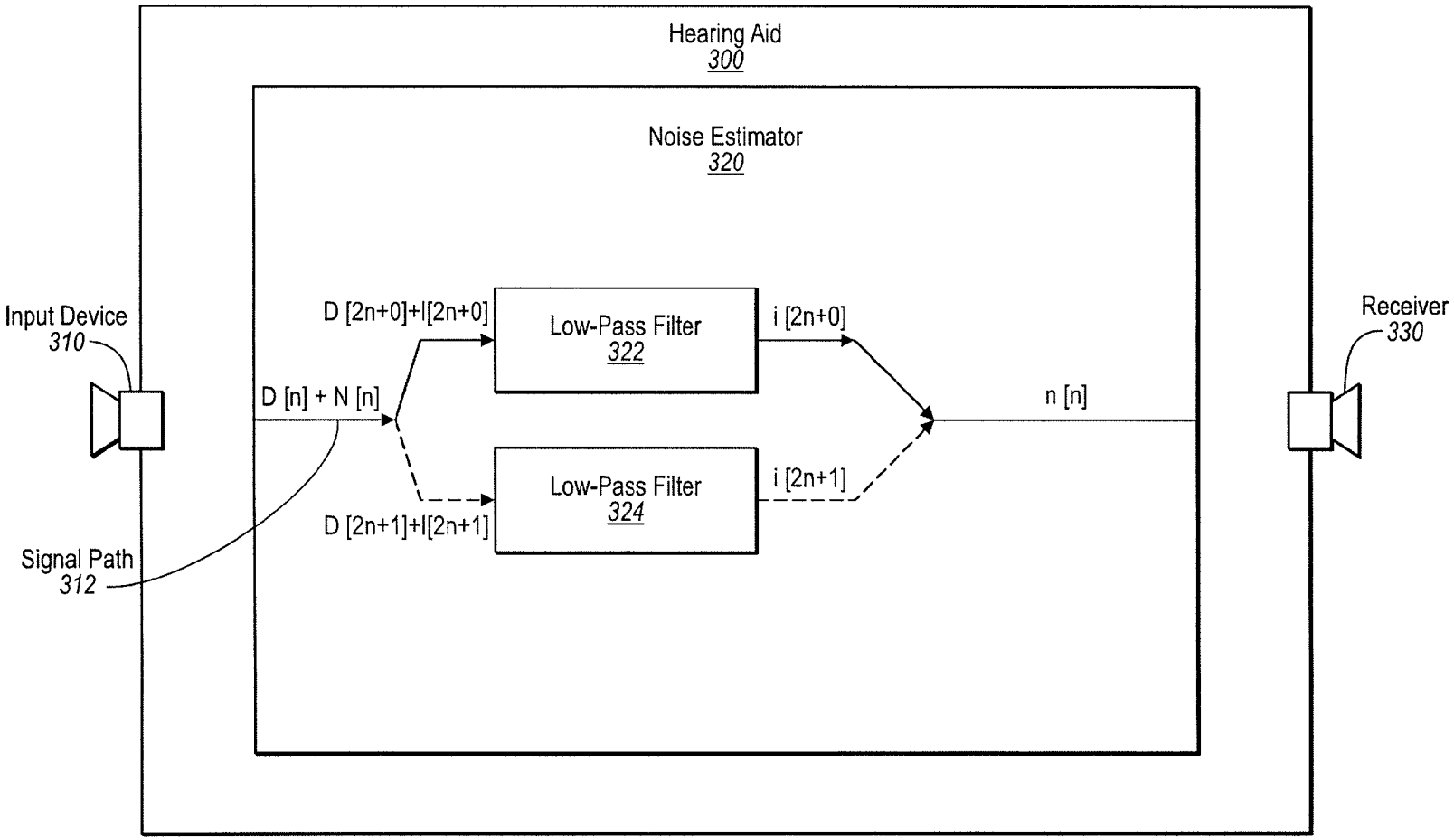
FIG. 3 is a block diagram of an exemplary hearing aid with a noise estimator according to certain embodiments.
Figure 5:
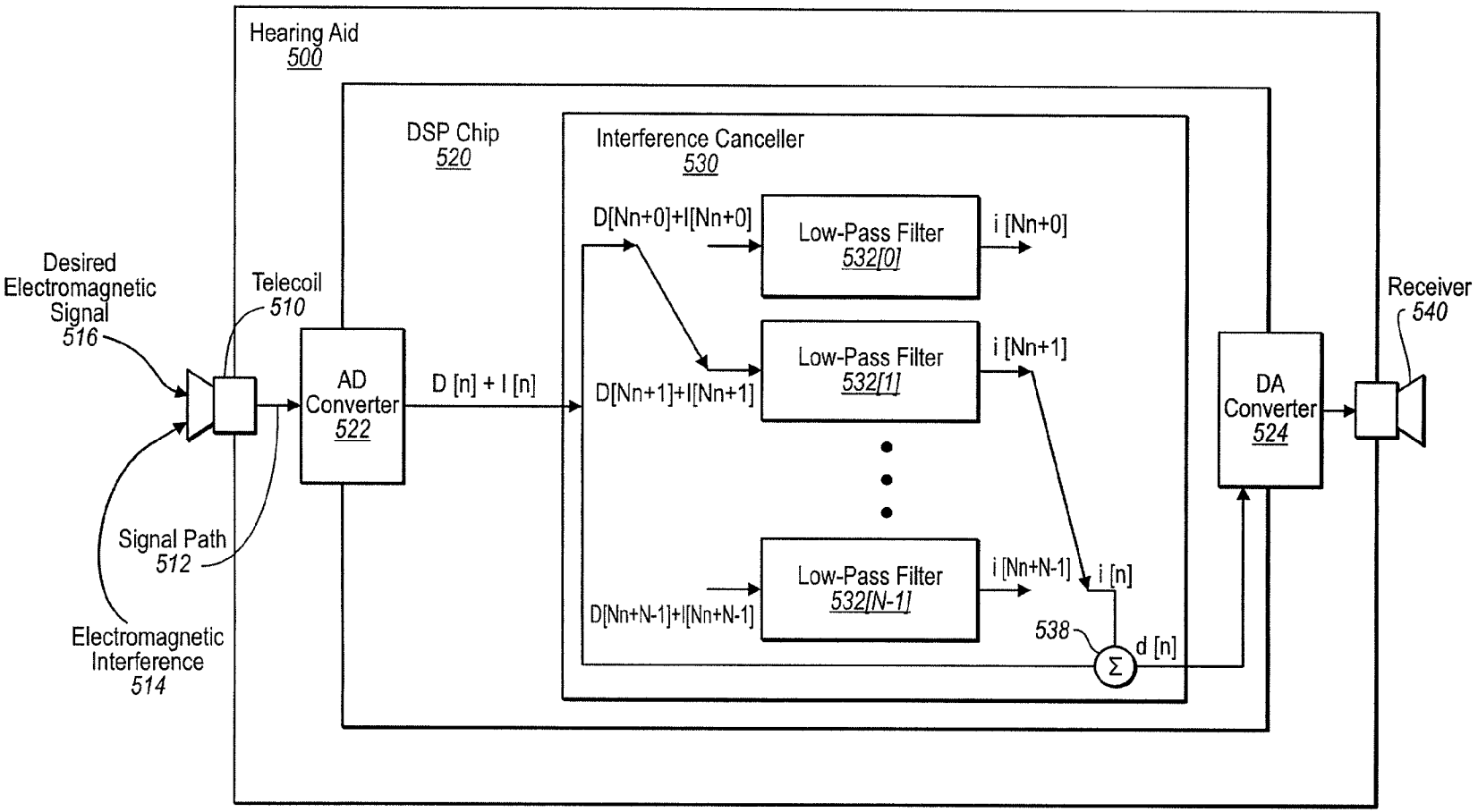
FIG. 5 is a block diagram of a hearing aid with an exemplary interference canceller according to certain embodiments.
Figure 6:
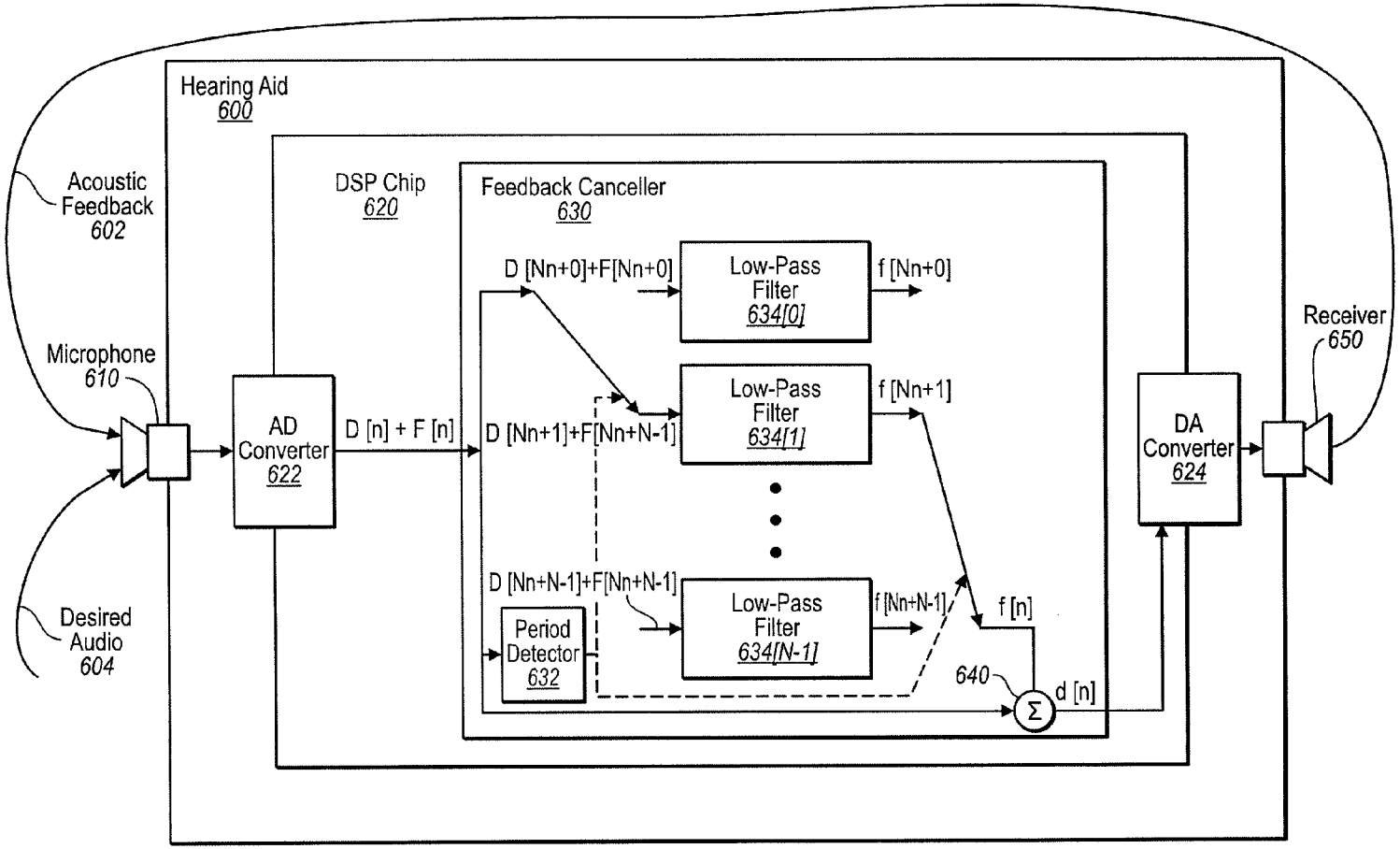
FIG. 6 is a block diagram of a hearing aid with an exemplary feedback canceller according to certain embodiments.
Figure 7:
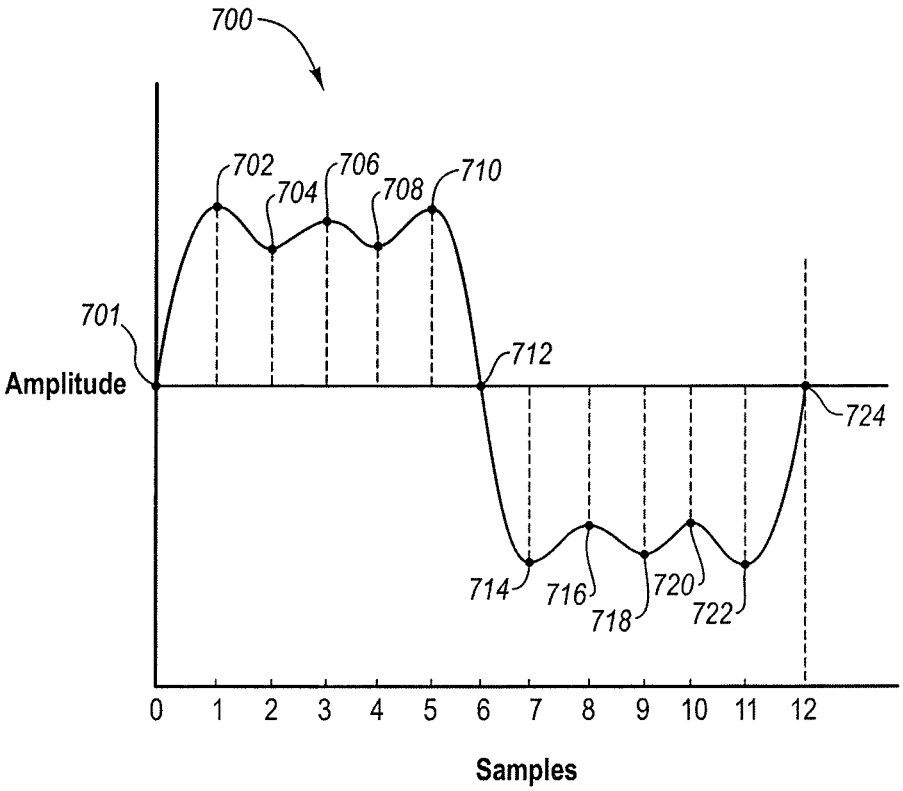
FIG. 7 is a graph of one period of an exemplary interference signal according to certain embodiments.
Figure 8:
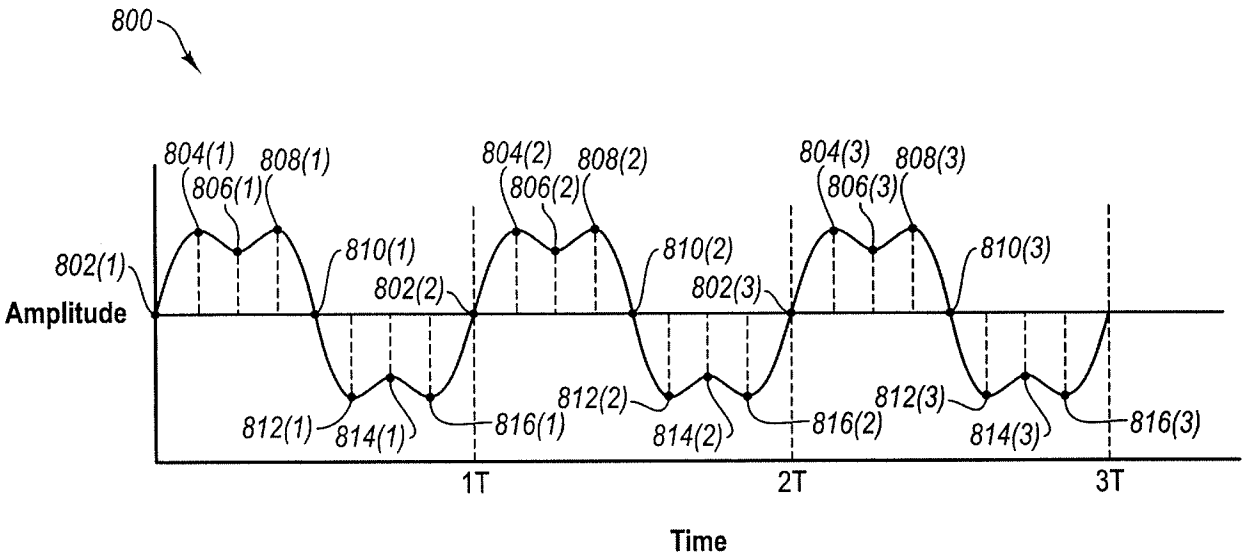
FIG. 8 is a graph of three periods of an exemplary interference signal according to certain embodiments.

The following disclosure begins by introducing general principles of exemplary methods and systems for determining noise (FIGS. 1-3). The disclosure then turns to using noise estimations to cancel electromagnetic interference (FIGS. 4 and 5) and acoustic feedback (FIG. 6). The disclosure concludes with examples of how streams of input signal samples may be averaged to estimate a waveform of a noise signal (FIGS. 7 and 8).

FIG. 1 illustrates a hearing aid 100. Hearing aid 100 may include a microphone (positioned behind microphone port 110), a telecoil 120, and a switch 130. Switch 130 may allow a user of hearing aid 100 to toggle between microphone and telecoil modes of hearing aid 100. Hearing aid 100 may also include a receiver 140 for transmitting sound into a user's ear. The microphone and receiver 140 may comprise any suitable electroacoustic transducers, and telecoil 120 may be any suitable electromagnetic transducer. Hearing aid 100 may also include a Digital Signal Processing (DSP) chip 105 capable of implementing various methods and embodiments disclosed herein.

Embodiments of the instant disclosure may be implemented in various types of hearing aids, such as completely-in-the-canal hearing aids, mini-canal hearing aids, in-the-canal hearing aids, half-shell hearing aids, in-the-ear hearing aids, behind-the-ear hearing aids, open-ear hearing aids, receiver-in-the-ear hearing aids, or any other suitable types of hearing aids. Embodiments of the instant disclosure may also be implemented using digital technologies, analog technologies, or any combination of digital and analog technologies. Digital implementations may involve computer hardware, firmware, and/or software. For example, some embodiments may be implemented as computer-implemented methods. Computer-implemented methods disclosed herein may be partially or completely implemented in DSP chips positioned in a hearing aid signal path between an input device and a receiver.

FIG. 2 shows a computer-implemented method 200 for determining noise. The phrase "determining noise" may refer to estimating, modeling, detecting, or otherwise creating a waveform of a noise signal. Determining a noise waveform may be an important part of the process of reducing or eliminating noise from an input signal, as discussed in the disclosure corresponding to FIGS. 4 and 5.

The steps illustrated in FIG. 2 may be performed by a noise estimator, which may be any device capable of low-pass filtering an input signal. The noise estimator may receive a first signal from an input device of a hearing aid (step 210). The first signal may comprise a noise signal. The first signal may also comprise a desired signal and may be a combination of the desired signal and the noise signal. In other embodiments, the first signal may comprise only the noise signal.

The input device may be a microphone, a telecoil, or any other device capable of transforming acoustic or electromagnetic energy into an electrical signal. In some embodiments, the hearing aid may perform one or more preprocessing functions on the first signal before the first signal arrives at the noise estimator. For example, the hearing aid may sample the first signal, may apply gain to the first signal, or may perform any other suitable processing function on the first signal. In at least one embodiment, signals from one or more input devices may be mixed to create the first signal. Thus, "receiving a first signal from an input device" may refer to receiving a signal directly from one or more input devices or receiving a signal that has been sent from one or more input devices through one or more processing steps.

The noise estimator may determine a waveform of the noise signal by low-pass filtering two or more streams of samples of the first signal. For example, the noise estimator may low-pass filter first periodic samples of the first signal (step 220). The first periodic samples may be approximately periodic with respect to a period of the noise signal. The phrase "periodic samples" may refer to a stream of samples with each sample in the stream being delayed by a period of time. For example, the samples comprising the first periodic samples may each be separated by one period of the noise signal. The phrase "approximately periodic with respect to a period of the noise signal" may refer to samples that are separated by one period or almost one period (e.g., slightly less or more than one period) of a frequency of the noise signal. Samples that are approximately periodic with respect to the period of the noise signal may have a period approximately equal to the inverse of a fundamental frequency of the noise signal or the inverse of any other harmonic frequency of the noise signal.

The noise estimator may also low-pass filter second periodic samples of the first signal (step 230). The second periodic samples may be approximately periodic with respect to the period of the noise signal. Furthermore, the second periodic samples may be phase shifted relative to the first periodic samples. A first set of samples may be phase shifted relative to a second set of samples when the first set of samples is shifted in time with respect to (e.g., out of phase with) the second set of samples.

Low-pass filtering first periodic samples in the manner described in FIG. 2 may provide a time average of a first point or sample position of a period of the noise signal, and low-pass filtering second periodic samples may provide a time average of a second point or sample position of a period of the noise signal. FIGS. 7 and 8 show exemplary sample positions of a period of a noise signal. Over time, signals that do not have the same period as the noise signal may average to zero (or approximately zero), leaving only the noise signal.

FIG. 3 shows a block diagram of an exemplary hearing aid 300 with an input device 310, a receiver 330, and a noise estimator 320 capable of implementing the steps illustrated in FIG. 2. Noise estimator 320 may be in a signal path 312 between input device 310 and receiver 330. Input device 310 may be a microphone, a telecoil, a Direct Audio Input (DAI), or any other suitable hearing aid input device. Noise estimator 320 may comprise a low-pass filter 322 and a low-pass filter 324. Low-pass filters 322 and 324 may be first order low-pass filters or filters of any other suitable order. Noise estimator 320 may receive a first signal (D[n]+I[n]) from input device 310. The first signal may comprise two components—a desired signal (D[n]) and an interfering noise signal (I[n]).

Noise estimator 320 may cycle through low-pass filters 322 and 324 one time for each period of the noise signal. In other words, noise estimator 320 may send one sample to each of low-pass filters 322 and 324 during each period of the noise signal. As shown in FIG. 3, noise estimator 320 may send a signal D[2n+0]+I[2n+0] to low-pass filter 322. The notation "D[2n+0]+I[2n+0]" may refer to first periodic samples of the first signal, where D[2n+0] may represent a desired component of the stream of samples and I[0] may represent a noise component of the stream of samples. The first periodic samples may comprise a first sample from two or more periods of the noise signal. Noise estimator 320 may send a signal D[2n+1]+I[2n+1] to low-pass filter 324. The notation "D[2n+1]+I[2n+1]" may refer to second periodic samples of the first signal. The second periodic samples may comprise a second sample from two or more periods of the noise signal.

Noise estimator 320 may send signal samples to low-pass filters 322 and 324 by demultiplexing a set of incoming samples. Noise estimator 320 may also use any other suitable mechanism for providing samples to low-pass filters 322 and 324. Typically, filters 322 and 324 are unity-gain filters. However, in some embodiments, filters 322 and 324 may apply gain to incoming signals.

FIG. 3 shows two low-pass filters because a periodic signal, in order to be estimated properly, may require a minimum of two samples per period of the signal. However, the input signal to noise estimator 320 may typically comprise many more than just two samples per period of the noise signal. Noise estimator 320 may include a low-pass filter for each sample in a period of the noise signal, and may include numerous low-pass filters. FIGS. 5 and 6 illustrate embodiments with more than two low-pass filters.

The output of low-pass filter 322 may be an average of the first periodic samples. As previously noted, the first periodic samples may be represented by D[2n+0]+I[2n+0]. Averaging the first periodic samples may decrease or eliminate the presence of desired signal D[2n+0]. Thus, low-pass filter 322 may estimate the interfering noise signal I[2n+0] by filtering out desired signal D[2n+0]. As shown, low-pass filter 322 may output an estimation of noise signal I[2n+0] (the estimation of noise signal I[2n+0] is represented by the notation "i[2n+0]"). Similarly, low-pass filter 324 may filter out desired signal D[2n+1] and may output an estimation of noise signal I[2n+1] (the estimation of noise signal I[2n+1] is represented by the notation "i[2n+1]").

The ability of a low-pass filter to filter out the desired signal may be related to the bandwidth of the low-pass filter. For example, a low-pass filter with a narrower bandwidth may do a better job eliminating desired signals than a low-pass filter with a wider bandwidth. In other words, a low-pass filter with a narrower bandwidth may provide a better average (e.g., may average more samples) of a noise signal than a low-pass filter with a wider bandwidth. However, narrow band low-pass filters may have slower response times than low-pass filters with wider bands. Thus, in some embodiments, there may be a trade-off between how quickly a filter responds to periodic noise and how accurately the filter eliminates the noise without affecting the desired signal. In some embodiments, a time constant of one or more of the low-pass filters may be between 100 milliseconds and 10,000 milliseconds. A filter with a time-constant in this range may provide accurate filtering of noise signals and respond quickly enough to provide minimal delay of noise cancellation. In some embodiments, a time constant of one or more of the low-pass filters may be any suitable value, including less than 100 milliseconds or more than 10,000 milliseconds.

A noise estimator, such as noise estimator 320, may be any device capable of estimating, determining, or otherwise modeling noise or a waveform of a noise signal. In some embodiments, a noise estimator may comprise a noise canceller and may be configured to subtract a waveform of a noise signal from an input signal. In other embodiments, a noise estimator may be used in conjunction with a device capable of subtracting a waveform of a noise signal from an input signal. Subtracting a noise signal from an input signal may reduce or eliminate (e.g., cancel) the noise carried in the input signal, as discussed in FIG. 4.

Figure 4:
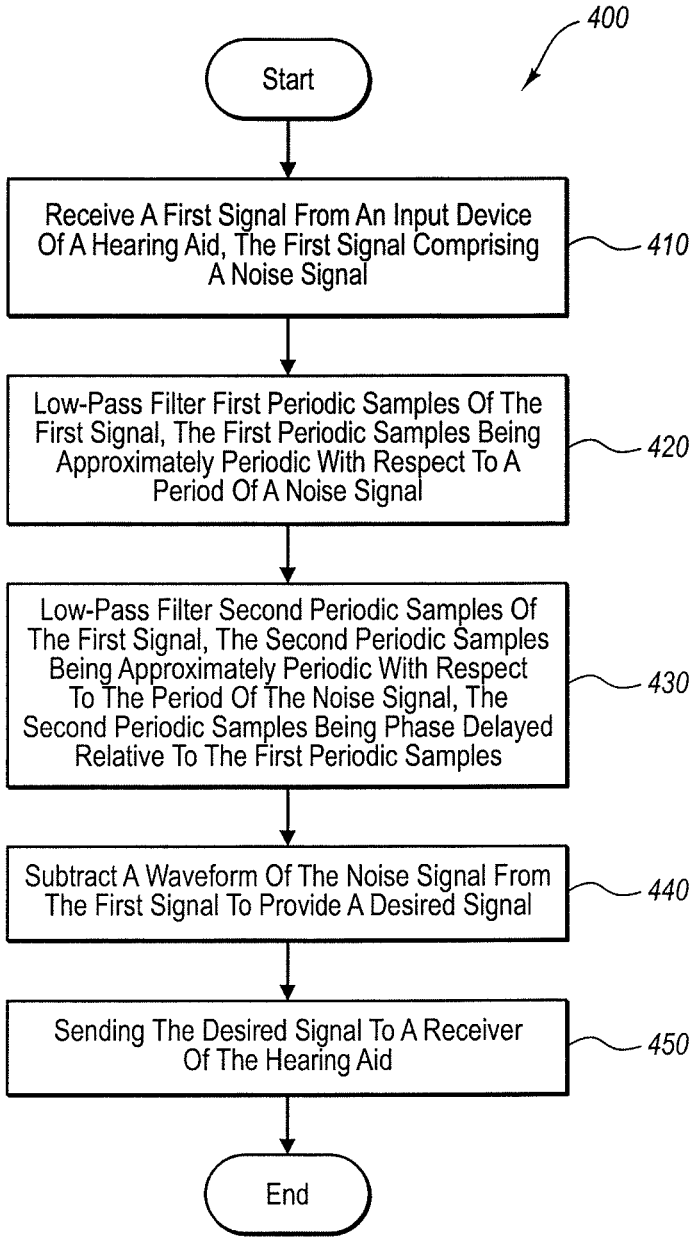
FIG. 4 is a flow diagram of an exemplary noise reduction method according to certain embodiments.

FIG. 4 shows a method 400 for reducing noise in a first signal. A noise reduction device may receive a first signal from an input device of a hearing aid (step 410). The first signal may comprise a noise signal. The noise reduction device may low-pass filter first periodic samples of the first signal (step 420). The first periodic samples may be approximately periodic with respect to a period of a noise signal. The noise reduction device may low-pass filter the first periodic samples by using any device or algorithm capable of averaging the first periodic samples.

The noise reduction device may also low-pass filter second periodic samples of the first signal (step 430). The second periodic samples may be approximately periodic with respect to the period of the noise signal. The second periodic samples may also be phase shifted relative to the first periodic samples. The results of low-pass filtering the first and second periodic samples may provide a waveform of the noise signal (e.g., an estimate of the noise signal). The noise reduction device may then subtract the waveform of the noise signal from the first signal (step 440).

By subtracting the waveform of the noise signal from the first signal, the noise reduction device may reduce or eliminate the noise from the first signal. Thus, a result of the subtraction may be a signal that at least substantially comprises just the desired signal. In other words, the noise reduction device may subtract the waveform of the noise signal from the first signal to provide an estimation of the desired signal. Then, the noise reduction device may send the desired signal to a receiver of the hearing aid.

The noise reduction device may send the result of the subtraction (i.e., the desired signal) to a receiver of the hearing aid (step 450). Sending the desired signal to the receiver may comprise sending the desired signal directly to the receiver or sending the desired signal to the receiver through other devices or processes. The receiver may then transmit the desired signal to the hearing aid user.

FIG. 5 is a block diagram of a hearing aid 500 configured to implement at least one embodiment of the instant disclosure. Hearing aid 500 may comprise a telecoil 510, a DSP chip 520, and a receiver 540. DSP chip 520 may comprise an analog-to-digital converter 522, a digital-to-analog converter 524, and an interference canceller 530. Interference canceller 530 may comprise a number of low-pass filters 532.

Telecoil 510 may receive electromagnetic signals, such as desired electromagnetic signal 516. Desired electromagnetic signal 516 may be, for example, an electromagnetic field created by a telephone speaker. Telecoil 510 may also receive electromagnetic interference 514. In some embodiments, electromagnetic interference 514 may be created by circuitry or components within hearing aid 500. For example, electromagnetic interference 514 may be created by a power-supply loop in hearing aid 500. In such embodiments, an amplifier circuit of hearing aid 500 may run on an internal clock, and the amplifier circuit's current consumption from a battery may periodically fluctuate at integer multiples of the internal clock period. Thus, if the clock oscillates at 2.048 megahertz, the current consumption of the amplifier circuit may oscillate at an integer divisor of 2.048 megahertz. The fundamental frequency of this oscillation may occur in the audio frequency range of 100 to 10,000 hertz.

The oscillating current consumption of the amplifier circuit may cause a power supply loop through the hearing aid to create a time-varying magnetic field. This magnetic field (i.e., electromagnetic interference 514) may also oscillate at an integer divisor of the internal clock in the audio frequency range of 100 to 10,000 hertz. Telecoil 510 may detect the time-varying magnetic field, which may sound like a buzz to a user of hearing aid 500 if the frequency of variation, is in the audio frequency range. In this example, electromagnetic interference 514 may have a fundamental frequency of 333 hertz. In some embodiments, electromagnetic interference 514 may have a fundamental frequency between 100 hertz and 10,000 hertz. Electromagnetic interference 514 may also have a fundamental frequency of more than 10,000 hertz or less than 100 hertz.

Telecoil 510 may convert desired electromagnetic signal 516 and electromagnetic interference 514 into an electrical signal. Telecoil 510 may send the electrical signal to analog-to-digital converter 522 of DSP chip 520 over signal path 512. Analog-to-digital converter 522 may include a sampler for sampling the incoming analog signal. Analog-to-digital converter 522 may also perform other processing functions, such as low-pass filtering and quantizing. Analog-to-digital converter 522 may send a digital signal (D[n]+I[n]) to interference canceller 530.

Interference canceller 530 may comprise "N" low-pass filters: low-pass filter 532[0] through low-pass filter 532[N−1]. Low-pass filter 532[0] may receive a stream of samples D[Nn+0]+I[Nn+0] from analog-to-digital converter 522. D[Nn+0] may represent a desired component (i.e., a component associated with desired electromagnetic signal 516) of the stream of samples, and I[Nn+0] may represent an interference component (i.e., a component associated with electromagnetic interference 514) of the stream of samples. Low-pass filter 532[1] may receive a stream of samples D[Nn+1]+I[Nn+1], and low-pass filter 532[N−1] may receive a stream of samples D[Nn+N−1]+I[Nn+N−1].

Each stream of samples may correspond to a sample position of a period of electromagnetic interference 514. For example, low-pass filter 532[0] may receive a stream of samples that corresponds to a first sample of a period of electromagnetic interference 514. Thus, low-pass filter 532[0] may receive the first sample of each period of electromagnetic interference 514. Low-pass filter 532[0] may average these samples to provide an output i[Nn+0], which may be an estimate of I[nN+0]. Similarly, low-pass filter 532[1] may output i[Nn+1], which may be an estimate of I[Nn+1], and low-pass filter 532[N−1] may output i[Nn+N−1], which may be an estimate of I[Nn+N−1].

Interference canceller 530 may multiplex or otherwise combine the outputs of low-pass filters 532 to provide an estimate i[n] of electromagnetic interference 514. Then, an adder 538 may subtract the estimate i[n] of electromagnetic interference 514 from the input signal, D[n]+I[n], thereby providing an estimate d[n] of desired electromagnetic signal 516. Adder 538 may be any suitable arithmetic unit. Interference canceller 530 may send the estimate d[n] of desired electromagnetic signal 516 to digital-to-analog converter 524. Digital-to-analog converter 524 may send the desired signal to receiver 540, and receiver 540 may output the desired signal to a user of hearing aid 500.

FIG. 6 is a block diagram of a hearing aid 600 configured to implement at least one embodiment of the instant disclosure. Hearing aid 600 may comprise a microphone 610, a DSP chip 620, and a receiver 650. DSP chip 620 may comprise an analog-to-digital converter 622, a digital-to-analog converter 624, and a feedback canceller 630. Feedback canceller 630 may comprise a number of low pass filters 634.

Microphone 610 may receive audio signals, such as desired audio 604. Desired audio 604 may be speech, music, or any other audio signal a hearing aid user may wish to hear. Microphone 610 may also receive acoustic feedback 602. Acoustic feedback 602 may be sound that leaks from receiver 650 to microphone 610.

Acoustic feedback 602 may occur at frequencies related to an audio loop delay through hearing aid 600. For example, a lowest frequency of acoustic feedback may equal a reciprocal of the audio loop delay. In a non-dispersive system, other frequencies of acoustic feedback may occur at integer multiples of the lowest frequency. Acoustic feedback can cause a hearing aid to output a squealing noise that persists until the feedback is eliminated, and acoustic feedback is a problem in many hearing aids.

Microphone 610 may convert acoustic feedback 602 and desired audio 604 into an electrical signal. Microphone 610 may send the electrical signal to analog-to-digital converter 622 of DSP chip 620. Analog-to-digital converter 622 may include a sampler for sampling the incoming analog signal. Analog-to-digital converter 622 may send a digital signal (D[n]+F[n]) to feedback canceller 630.

Feedback canceller 630 may comprise a period detector 632. Period detector 632 may be configured to detect a period of acoustic feedback 602. In some embodiments, period detector 632 may detect a period of a fundamental frequency of acoustic feedback 602. Period detector 632 may detect the period of acoustic feedback 602 by performing spectral analysis, with a phase-locked loop, with a zero-crossing detector, or with any other mechanism suitable for detecting the period of a signal. FIG. 6 shows a period detector used for detecting a period of acoustic feedback. According to some embodiments, period detectors may be used to detect periods of various other types of noise. In at least one embodiment, a period detector may not be needed in an acoustic feedback canceller.

After detecting a period of acoustic feedback 602, period detector 632 may synchronize low-pass filters 634 with the period of the acoustic feedback 602. For example, period detector 632 may cause feedback canceller 630 to cycle through each of filters 634 once for every period of acoustic feedback 602. Thus, the number of filters in feedback canceller 630 may correspond to the number of samples in the period of acoustic feedback 602. In other embodiments, the number of filters in feedback canceller 630 may be less than the number of samples in the period of acoustic feedback 602, which may be referred to as subsampling. For example, the number of filters in feedback canceller 630 may be approximately one-half the number of samples in the period of acoustic feedback 602, one-fourth the number of samples in the period of acoustic feedback 602, or any other fraction of the number of samples in the period of acoustic feedback 602. In other embodiments, the number of filters in feedback canceller 630 may be greater than the number of samples in the period of acoustic feedback 602. In such embodiments, period detector may cause feedback canceller to skip one or more low-pass filters to synchronize with the period of acoustic feedback 602.

Period detector 632 may synchronize feedback canceller 630 with the period of acoustic feedback 602 (or conversely, may synchronize the period of acoustic feedback 602 with feedback canceller 630) by duplicating one or more samples of the incoming signal, by skipping one or more samples of the incoming signal, and/or by interpolating samples of the incoming signal. Period detector 632 may duplicate, skip, or interpolate samples for various reasons. For example, the period of acoustic feedback 602 may not generally correspond to an integer number of samples, and period detector 632 may need to skip, duplicate, or interpolate samples to synchronize feedback canceller 630 with the period of acoustic feedback 602. Feedback canceller 630 may also skip samples as part of a subsampling process.

Feedback canceller 630 may comprise "N" low-pass filters: low-pass filter 634[0] through low-pass filter 634[N−1]. Low-pass filter 634[0] may receive a stream of samples D[Nn+0]+F[Nn+0] from analog-to-digital converter 622, where D[Nn+0] may represent a desired component (i.e., a component associated with desired audio 604) of the stream of samples, and F[Nn+0] may represent a feedback component (i.e., a component associated with acoustic feedback 602) of the stream of samples. Low-pass filter 634[1] may receive a stream of samples D[Nn+1]+F[Nn+1], and low-pass filter 634[N−1] may receive a stream of samples D[Nn+N−1]+F[Nn+N−1].

Each stream of samples may correspond to a sample position of a period of a fundamental frequency of acoustic feedback 602. For example, low-pass filter 634[0] may receive a stream of samples that corresponds to a first sample of a period of acoustic feedback 602. Thus, low-pass filter 634[0] may receive the first sample of each period of acoustic feedback 602. Low-pass filter 634[0] may average these samples to provide an output f[Nn+0], which may be an estimate of F[Nn+0]. Similarly, low-pass filter 634[1] may output f[Nn+1], which may be an estimate of F[Nn+1], and low-pass filter 634[N−1] may output f[Nn+N−1], which may be an estimate of F[Nn+N−1].

Feedback canceller 630 may multiplex or otherwise combine the outputs of low-pass filters 634 to provide an estimate f[n] of acoustic feedback 602. Then, an adder 640 may subtract the estimate f[n] of acoustic feedback 602 from the input signal, D[n]+F[n], thereby providing an estimate d[n] of desired audio 604. Feedback canceller 630 may send the estimate d[n] of desired audio 604 to digital-to-analog converter 624. If period detector 632 has altered the sample rate to synchronize the feedback canceller 630 with the period of acoustic feedback 602, then period detector 632 may convert the sample rate of estimate f[n] or of d[n] as appropriate to synchronize it with the input signal D[n]+F[n] or DA Converter 624. Digital-to-analog converter 624 may send the desired signal to receiver 650, and receiver 650 may output the desired signal to a user of hearing aid 600.

FIG. 7 shows one period of a waveform of a noise signal 700. Noise signal 700 may comprise a fundamental frequency as well as 3rd and 5th harmonics of the fundamental frequency. A sampler may capture samples 702-724 of noise signal 700. Each of these samples may be filtered by a different low-pass filter. For example, sample 702 may be sent to a first low-pass filter (e.g., low-pass filter 532[0]), sample 704 may be sent to a second low-pass filter (e.g., low-pass filter 532[1]), and sample 724 may be filtered by an "Nth" low-pass filter (e.g., low-pass filter 532[N−1]).

Low-pass filter 532[0] may be associated with a first sample position of a period of noise signal 700. The first sample position may be phase shifted relative to a starting point 701 of a period of noise signal 700. Low-pass filter 532[0] may filter first periodic samples of noise signal 700 by filtering a stream of samples 702 that corresponds to sample position 1. Similarly, low-pass filter 532[1] may filter second periodic samples of noise signal 700 by filtering a stream of samples 704 that corresponds to sample position 2.

FIG. 7 also shows sample positions 3 through 12 corresponding to samples 704 through 724 respectively, each representing a different phase shift relative to starting point 701. A different low-pass filter may be associated with each of these sample positions and may filter periodic samples that correspond to (e.g., are sampled at) the sample positions.

FIG. 8 shows three periods of a waveform of a noise signal 800. Noise signal 800 may comprise a fundamental frequency and a third harmonic of the fundamental frequency. Noise signal 800 may have a period of time T. A hearing aid may sample noise signal 800 eight times per period. A noise canceller may divide the incoming samples into eight sample streams: 802, 804, 806, 808, 810, 812, 814, and 816. Each sample stream may correspond to a low-pass filter. Thus, a first low-pass filter may filter sample stream 802, which may include samples 802(1), 802(2), and 802(3). Samples 802(1), 802(2), and 802(3) may also be referred to as first periodic samples with a period of T. A second low-pass filter may filter sample stream 804, which may include samples 804(1), 804(2), and 804(3). Samples 804(1), 804(2), and 804(3) may also be referred to as second periodic samples with a period of T. As shown, sample stream 802 may be phase shifted relative to sample stream 804.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of computer hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional hearing aids, one or more of these exemplary embodiments may be distributed as a DSP chip or a software product in a variety of forms, regardless of the particular type of computer-readable media used to actually carry out the distribution. The embodiments disclosed herein may also be implemented using software modules that perform certain tasks. In some embodiments, these software modules may configure a computing device to perform one or more of the exemplary embodiments disclosed herein.

The preceding description has been provided to enable others skilled in the art to best utilize various aspects of the exemplary embodiments disclosed herein. This exemplary description is not intended to be exhaustive or to be limited to any precise form disclosed. Many modifications and variations are possible without departing from the spirit and scope of the instant disclosure. The embodiments disclosed herein should be considered in all respects illustrative and not restrictive. Reference should be made to the appended claims and their equivalents in determining the scope of the instant disclosure.

The invention claimed is:

1. A computer-implemented method for reducing noise in hearing aids, the computer-implemented method comprising:

receiving a first signal from an input device of a hearing aid, the first signal comprising a noise signal;

low-pass filtering first periodic samples of the first signal with a first low-pass filter, the first periodic samples being approximately periodic with respect to a period of the noise signal, the low-pass filtering of the first periodic samples providing a time average of a first sample position of the period of the noise signal; and low-pass filtering second periodic samples of the first signal with a second low-pass filter, the second periodic samples being approximately periodic with respect to the period of the noise signal, the second periodic samples being phase shifted relative to the first periodic samples, the low-pass filtering of the second periodic samples providing a time average of a second sample position of the period of the noise signal.

2. The computer-implemented method of claim 1, further comprising:

determining a waveform of the noise signal, wherein determining the waveform comprises low-pass filtering the first periodic samples and low-pass filtering the second periodic samples;

subtracting the waveform of the noise signal from the first signal to provide a desired signal;

sending the desired signal to a receiver of the hearing aid.

3. The computer-implemented method of claim 1, further comprising:

determining a waveform of the noise signal, wherein: determining the waveform comprises low-pass filtering a plurality of streams of periodic samples;

the first periodic samples comprise a first stream of periodic samples from the plurality of streams of periodic samples;

the second periodic samples comprise a second stream of periodic samples from the plurality of streams of periodic samples.

4. The computer-implemented method of claim 3, wherein:

one period of the noise signal comprises a number of samples; and the number of streams in the plurality of streams of periodic samples corresponds to the number of samples in one period of the noise signal.

5. The computer-implemented method of claim 1, wherein the period of the noise signal comprises a period of a fundamental frequency of the noise signal.

6. The computer-implemented method of claim 5, wherein the fundamental frequency comprises a value between 100 hertz and 10,000 hertz.

7. The computer-implemented method of claim 1, wherein the noise signal comprises a fundamental frequency and at least one harmonic of the fundamental frequency.

8. The computer-implemented method of claim 1, wherein:

the input device comprises a telecoil; and the noise signal comprises electromagnetic interference, the electromagnetic interference being created by the hearing aid.

9. The computer-implemented method of claim 8, wherein:

the electromagnetic interference is created by a power-supply loop in the hearing aid.

10. The computer-implemented method of claim 1, wherein:

the input device comprises a microphone; and the noise signal comprises acoustic feedback from the receiver.

11. The computer-implemented method of claim 10, wherein the period of the noise signal corresponds to a feedback-loop delay of the hearing aid.

12. The computer-implemented method of claim 1, further comprising:

determining the period of the noise signal, the period comprising a fundamental frequency of the noise signal.

13. The computer-implemented method of claim 12, further comprising:

synchronizing the low-pass filtered first periodic samples with the period of the noise signal; and synchronizing the low-pass filtered second periodic samples with the period of the noise signal.

14. The computer-implemented method of claim 13, wherein the synchronizing the low-pass filtered of first and second periodic samples with the period of the noise signal comprises at least one of:

duplicating a sample of the first signal;

skipping a sample of the first signal; and interpolating samples of the first signal.

15. A hearing aid, comprising:

an input device configured to output a first signal, the input device including a telecoil, the first signal including a noise signal, the noise signal including electromagnetic interference created by a power-supply loop in the hearing aid;

a receiver;

a noise estimator in a signal path between the input device and the receiver, the noise estimator including a first low-pass filter configured to filter first periodic samples of the first signal, the first periodic samples being approximately periodic with respect to a period of the noise signal, the first low-pass filter further configured to provide a time average of a first sample position of the period of the noise signal; and a second low-pass filter configured to filter second periodic samples of the first signal, the second periodic samples being approximately periodic with respect to the period of the noise signal, the second periodic samples being phase shifted relative to the first periodic samples, the second low-pass filter further configured to provide a time average of a second sample position of the period of the noise signal.

16. A computer-implemented method for reducing noise in hearing aids, the computer-implemented method comprising:

receiving a first signal from a telecoil of a hearing aid, the first signal comprising an interference signal, the interference signal comprising electromagnetic interference created by a power-supply loop in the hearing aid;

determining a waveform of the interference signal by low-pass filtering a first stream of periodic samples of the first signal with a first low-pass filter, the first stream of periodic samples being approximately periodic with respect to a period of a fundamental frequency of the interference signal, the low-pass filtering of the first stream providing a time average of a first sample position of the period of the fundamental frequency of the interference signal; and low-pass filtering a second stream of periodic samples of the first signal with a second low-pass filter, the second stream of periodic samples being approximately periodic with respect to the period of the fundamental frequency of the interference signal, the second stream of periodic samples being phase shifted relative to the first stream of periodic samples, the low-pass filtering of the second stream providing a time average of a second sample position of the period of the fundamental frequency of the interference signal;

subtracting the waveform of the interference signal from the first signal to provide a desired signal; and sending the desired signal to a receiver of the hearing aid.

17. The computer-implemented method of claim 16, wherein:

one period of the interference signal comprises a number of samples; and the number of streams in the plurality of streams of periodic samples is equal to the number of samples in one period of the interference signal.

18. The computer-implemented method of claim 16, wherein the fundamental frequency comprises an integer divisor of an audio sample rate of the hearing aid.

* * * * *